US005738567A

United States Patent [19]

Manzonie et al.

[11] Patent Number: 5,738,567

[45] Date of Patent: Apr. 14, 1998

[54] POLISHING PAD FOR CHEMICAL-MECHANICAL PLANARIZATION OF A SEMICONDUCTOR WAFER

[75] Inventors: Adam Manzonie, Austin, Tex.; Salman Akram, Boise, Id.

[73] Assignee: Micron Technology, Inc., Boise, Id.

[21] Appl. No.: 700,114

[22] Filed: Aug. 20, 1996

[51] Int. Cl.[6] ..... B24B 1/00

[52] U.S. Cl. ..... 451/41; 451/285; 451/66

[58] Field of Search ..... 15/230.16, 230; 451/285, 286, 287, 288, 289, 66, 41, 65, 57

[56] References Cited

U.S. PATENT DOCUMENTS

| | | | |
|---|---|---|---|
| 4,961,243 | 10/1990 | Barber | 15/230 |
| 4,998,314 | 3/1991 | Borofsky | 15/230 |
| 5,142,727 | 9/1992 | Koester | 15/230 |
| 5,377,378 | 1/1995 | Cutler | 15/230 |
| 5,578,529 | 11/1996 | Mullins | 451/287 |
| 5,616,069 | 4/1997 | Walker et al. | 451/285 |

*Primary Examiner*—Timothy V. Eley
*Assistant Examiner*—Derris H. Banks
*Attorney, Agent, or Firm*—Seed and Berry, LLP

[57] ABSTRACT

The present invention is a polishing pad that planarizes and cleans a semiconductor wafer in chemical-mechanical planarization processes. The polishing pad has a polishing body and a cleaning element positioned in the polishing body. The polishing body includes a planarizing surface, a basin formed in the body, and an opening at the planarizing surface defined by the basin. The cleaning element is positioned in the basin so that a cleaning surface of the cleaning element is positioned in the opening proximate to a plane defined by the planarizing surface. In operation, the cleaning surface periodically engages the wafer when the wafer is engaged with the pad to remove residual materials from the surface of the wafer.

27 Claims, 6 Drawing Sheets

POLISHING PAD FOR CHEMICAL-MECHANICAL PLANARIZATION OF A SEMICONDUCTOR WAFER

TECHNICAL FIELD

The present invention relates to polishing pads used in chemical-mechanical planarization of semiconductor wafers.

BACKGROUND OF THE INVENTION

Chemical-mechanical planarization ("CMP") processes remove material from the surface of a wafer in the production of ultra-high density integrated circuits. In a typical CMP process, a wafer is pressed against a polishing pad in the presence of a slurry under controlled chemical, pressure, velocity, and temperature conditions. The slurry solution generally contains small, abrasive particles that abrade the surface of the wafer, and chemicals that etch and/or oxidize the surface of the wafer. The polishing pad is generally a planar pad made from a relatively soft, porous material such as blown polyurethane. Thus, when the pad and/or the wafer moves with respect to the other, material is removed from the surface of the wafer by the abrasive particles (mechanical removal) and by the chemicals (chemical removal) in the slurry.

FIG. 1 schematically illustrates a conventional CMP machine 10 with a platen 20, a wafer carrier 30, a polishing pad 40, and a slurry 44 on the polishing pad. The platen 20 has a surface 22 upon which the polishing pad 40 is positioned. A drive assembly 26 rotates the platen 20 as indicated by arrow "A" and/or reciprocates the platen 20 back and forth as indicated by arrow "B". The motion of the platen 20 is imparted to the pad because the polishing pad 40 is attached to the surface 22 of the platen 20 with an adhesive. The wafer carrier 30 has a lower surface 32 to which a wafer 60 may be attached, or the wafer 60 may be attached to a resilient pad 34 positioned between the wafer 60 and the lower surface 32. The wafer carrier 30 may be a weighted, free-floating wafer carder, or an actuator assembly 36 may be attached to the wafer carrier 30 to impart axial and rotational motion, as indicated by arrows "C" and "D", respectively.

In operation of the conventional planarizer 10, the wafer 60 is positioned face-down against the polishing pad 40, and then the platen 20 and the wafer carrier 30 move relative to one another. As the face of the wafer 60 moves across the planarizing surface 42 of the polishing pad 40, the polishing pad 40 and the slurry 44 remove material from the wafer 60.

CMP processes must consistently and accurately produce a uniform, planar surface on the wafer to enable precise circuit and device patterns to be formed with photolithography techniques. As the density of integrated circuits increases, it is often necessary to accurately focus the critical dimensions of the photo-pattern to within a tolerance of approximately 0.1 μm. Focusing the photo-patterns to such small tolerances, however, is very difficult when the distance between the photolithography energy source and the surface of the wafer varies due to non-uniformities on the wafer. Thus, CMP processes must create a highly uniform, planar surface.

The surface of a wafer, however, may not be uniformly planar because the rate at which the thickness of the wafer decreases as it is being planarized (the "polishing rate") often varies from one area of the wafer to another. The polishing rate is a function of several factors, some of which are: (1) the uniformity of the slurry distribution across the surface of the wafer; (2) the surface contact rate between the polishing pad and the wafer; and (3) the extent to which residual materials aggregate near the center of the wafer. The slurry distribution varies across the face of the wafer because the perimeter of the wafer scrapes the slurry off the planarizing surface. Therefore, only a thin layer of slurry remains on the pad at the center of the wafer. The surface contact rate also varies across the face of the wafer because the linear velocity of the pad varies from the center of the pad to its perimeter. Lastly, residual particles of planarized wafer material and pieces of the pad can, for example, aggregate at the center of the wafer and form a barrier between the surface of the wafer and the slurry. The barrier of residual materials accordingly reduces the polishing rate at the center of the wafer. Therefore, in light of the above-listed problems, it would be desirable to enhance the slurry distribution, equalize the contact rate, and reduce the mount of residual materials on the surface of the wafer.

U.S. Pat. Nos. 5,020,283 to Tuttle, 5,293,364 to Tuttle, and 5,232,875 to Tuttle et al. disclose several existing polishing pads that enhance the slurry distribution and equalize the contact rate across the face of the wafer. The above-listed patents disclose polishing pads that have a face shaped by a series of voids to provide a nearly constant surface contact rate between the pad and the wafer. The voids also enhance the slurry distribution across the face of the wafer because they hold a small volume of slurry that is not scraped off the pad by the perimeter of the wafer. The above-listed patents, however, do not significantly reduce the amount of residual materials on the wafer.

Another objective of CMP processes is to minimize the number of defects on the finished planarized surface. The surface of the wafer is often damaged during the planarization process because residual particles from the pad or the wafer scratch the surface of the wafer. Thus, it would be desirable to develop a pad that reduces surface damage caused by residual particles.

SUMMARY OF THE INVENTION

The inventive polishing pad has a polishing body and a cleaning element positioned in the polishing body. The polishing body includes a planarizing surface, a basin formed in the body, and an opening at the planarizing surface defined by the basin. The cleaning element is positioned in the basin so that a cleaning surface of the cleaning element is positioned in the opening proximate to a plane defined by the planarizing surface. In operation, the cleaning surface periodically engages the wafer while it is engaged with the pad to remove residual materials from the surface of the wafer.

DETAILED DESCRIPTION OF THE INVENTION

The present invention is a polishing pad used in chemical-mechanical planarization of semiconductor wafers that cleans a wafer while it is being planarized. The polishing pad of the present invention also enhances the distribution of slurry across the face of the wafer and equalizes the contact rate between the wafer and the pad. An important aspect of the invention is that a non-abrasive cleaning element is positioned in a basin formed in the body of the pad. As the wafer is being planarized, the cleaning element periodically contacts the surface of the wafer to remove residual materials from the surface of the wafer and to wet the wafer with deionized water, additional slurry, or other desired chemicals. The size and shape of the cleaning element may also be configured to provide a substantially constant contact rate between the wafer and the planarizing surface of the polishing pad. The polishing pad of the present invention accordingly enhances the uniformity of the finished surface of the wafer and reduces scratches caused by large residual particles. FIGS. 2–12 illustrate polishing pads in accordance with the invention, and like reference numbers refer to like parts throughout the various figures.

Figure 1:
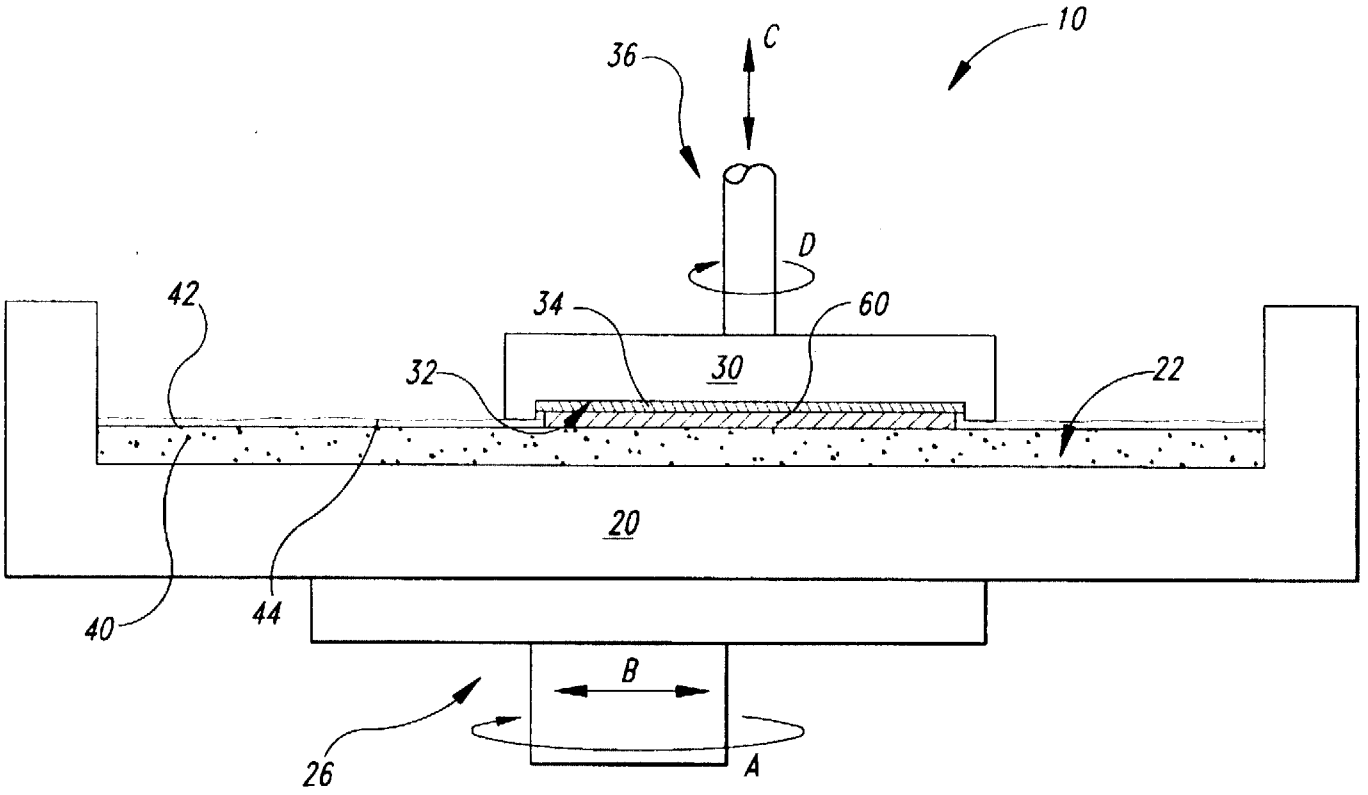
Fig. 1 (Prior Art)
FIG. 1 is a schematic cross-sectional view of a conventional chemical-mechanical planarizing machine in accordance with the prior art.
Figure 2:
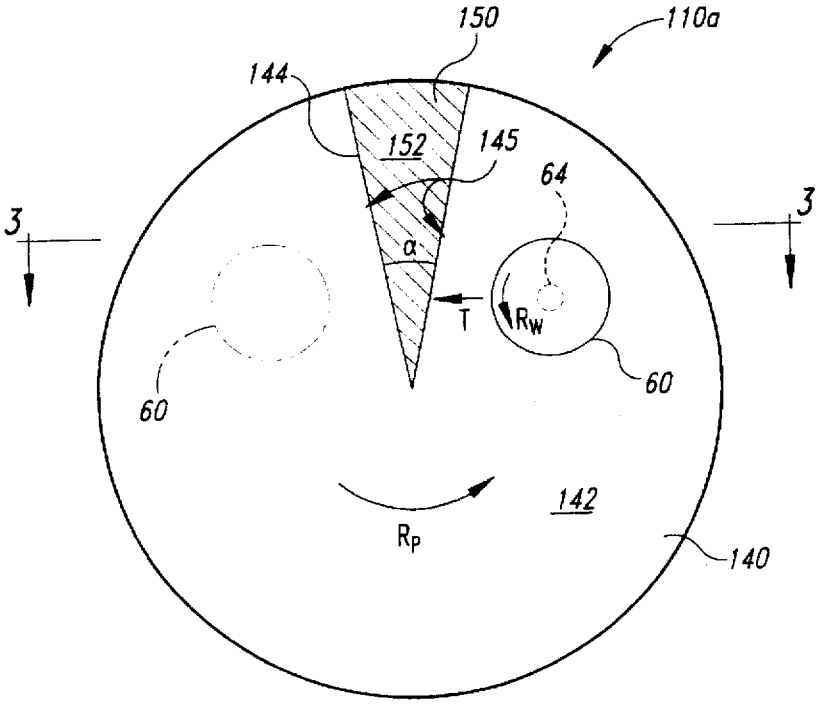
FIG. 2 is a schematic top plan view of a polishing pad for chemical-mechanical planarization of a semiconductor wafer in accordance with the present invention.
Figure 3:
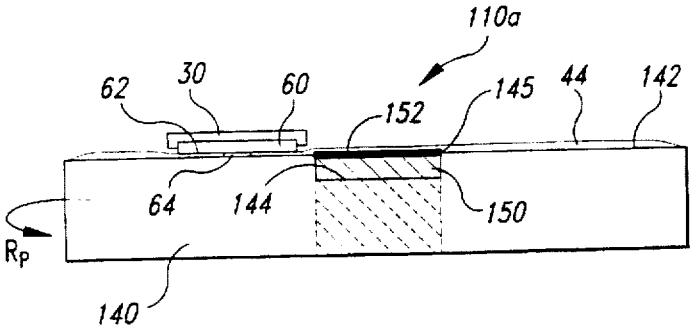
FIG. 3 is a schematic cross-sectional view of the polishing pad shown in FIG. 2.

FIGS. 2 and 3 illustrate a polishing pad 110(*a*) in accordance with the invention for use on a planarizing machine, such as the conventional CMP machine 10 discussed above with respect to FIG. 1. The pad 110(*a*) has a body 140 with a planarizing surface 142, a basin 144 formed in the body 140, and an opening 145 at the planarizing surface 142. The opening 145 is defined by the intersection between the planarizing surface 142 and the basin 144. The body 140 may be made from a number of materials including polymeric materials, or a combination of polymeric materials and abrasive filler materials. In one embodiment, the pad 140 is made from small abrasive particles suspended in a matrix of polyurethane. The basin 144 is preferably a trench that extends upwardly from an intermediate point in the body 140 to the planarizing surface 142, as shown in solid lines in FIG. 3. Alternatively, the basin 144 may be a channel formed through the body 140, as shown in phantom lines in FIG. 3. A cleaning element 150 with a cleaning surface 152 is positioned in the basin 144. The cleaning surface 152 is positioned in the opening 145 proximate to the plane defined by the planarizing surface 142 of the body 140. The cleaning element 150 is preferably made from a soft, non-abrasive material that cleans residual materials from the surface of the wafer without abrading the wafer. Suitable non-abrasive materials from which the cleaning element 150 can be made include, but are not limited to, polyvinyl alcohol and polyvinyl acetate.

Still referring to FIGS. 2 and 3, the pad 110(*a*) rotates in direction $R_P$, and the wafer 60 rotates and translates across the planarizing surface 142 of the pad 110(*a*) in the directions $R_W$ and T, respectively. As the pad 110(*a*) and the wafer 60 move with respect to each other, the surface 62 of the wafer 60 alternates between engaging the planarizing surface 142 and the cleaning surface 152. When the cleaning surface 152 of the cleaning element 150 engages the surface of the wafer, it removes an aggregation of residual material 64 from the surface 62 of the wafer 60 and traps the removed residual material to prevent it from re-aggregating on the wafer. In a preferred embodiment, the cleaning element 150 is either saturated with the slurry 44 or hydrated with deionized water to wet the surface 62 of the wafer 60 as it passes over the cleaning element 150.

The cleaning element 150 and the opening 145 may be configured into many different shapes, as discussed in detail below. When the cleaning element is wedge-shaped as shown in FIG. 2, an angle α between the side walls of the opening 145 may vary between 1 and 359 degrees, and is preferably between 10 and 60 degrees. The angle α, and thus the size of the cleaning element 150, is selected to provide the desired ratio between wafer planarizing and wafer cleaning for each revolution of the pad 140.

One advantage of the polishing pad 110(*a*) is that it provides a more uniform polishing rate across the face of the wafer because the cleaning element 150 periodically removes the residual material 64 from the surface 62 of the wafer 60. Since the polishing pad 110(*a*) eliminates the barrier created by the residual material 64, the slurry 44 readily contacts the center of the wafer 60. Thus, the polishing pad 110(*a*) provides a more uniform polishing rate across the whole surface 62 of the wafer 60.

Another advantage of the polishing pad 110(*a*) is that it enhances the distribution of slurry across the wafer because the cleaning element 150 wets the surface 62 of the wafer 60 with additional slurry. As the wafer 60 passes over a sponge-like cleaning element saturated with slurry, the cleaning element 150 wets the surface 62 of the wafer 60 with additional slurry. Thus, the center of the wafer 60 is exposed to additional slurry which enhances the uniformity of the polishing rate across the wafer.

Figure 4:
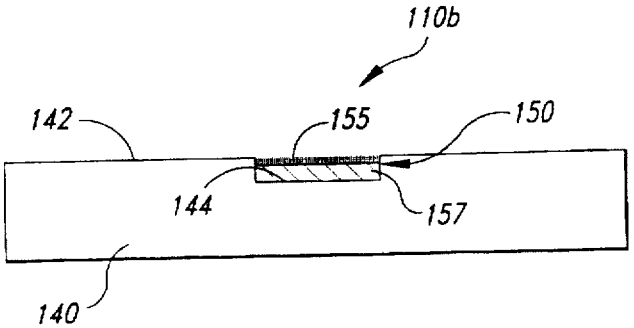
FIG. 4 is a schematic cross-sectional view of another polishing pad in accordance with the invention.

FIG. 4 illustrates another polishing pad 110(*b*) in accordance with the invention that has a body 140 and a brush-like cleaning element 150. A number of bristles 155 extend upwardly from the base 157 of the cleaning element 150 to engage the surface of the wafer (not shown). The bristles 155 of the cleaning element 150 are sufficiently stiff to remove the residual matter from the wafer, while also being sufficiently flexible to avoid abrading the wafer. The materials from which the bristles 155 may be made include, but are not limited to, flexible nylon, polyvinyl alcohol, or polyvinyl acetate. In operation, the polishing pad 110(*b*) removes and traps residual material in the same manner as the polishing pad 110(*a*) described above with respect to FIGS. 2 and 3.

Figure 5:
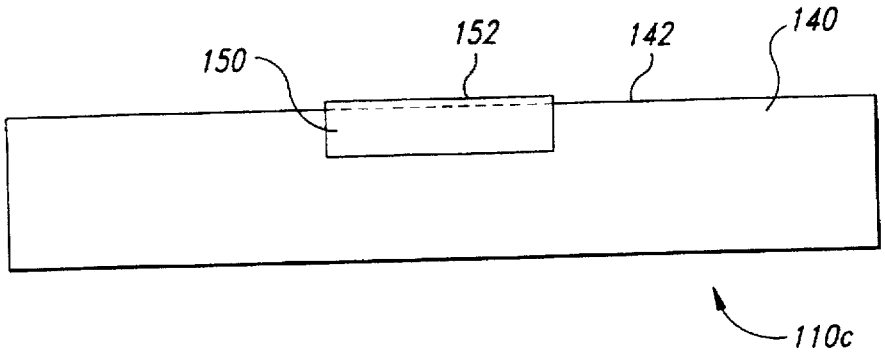
FIG. 5 is a schematic cross-sectional view of another polishing pad in accordance with the invention.
Figure 6:
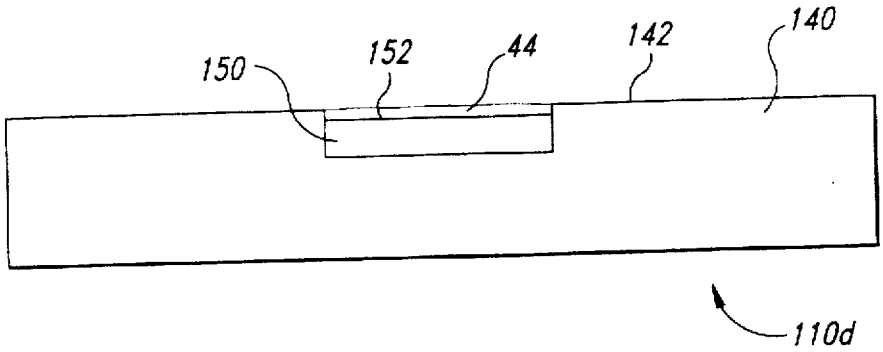
FIG. 6 is a schematic cross-sectional view of another polishing pad in accordance with the invention.
Figure 7:
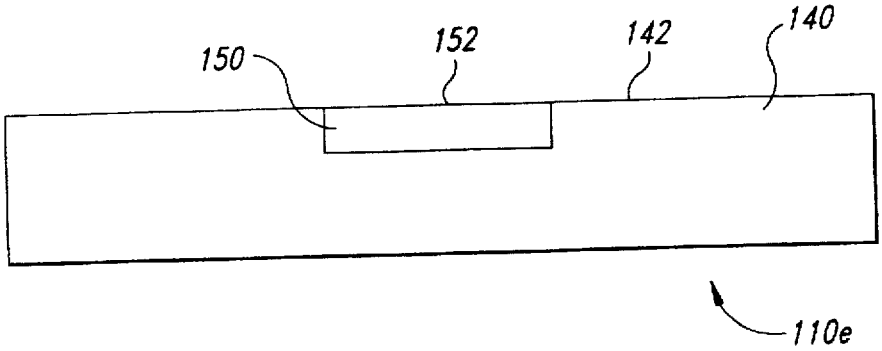
FIG. 7 is a schematic cross-sectional view of another polishing pad in accordance with the invention.

FIGS. 5–7 illustrate various embodiments of polishing pads in accordance with the invention in which the elevation of the cleaning surface 152 is varied with respect to the planarizing surface 142. FIG. 5 illustrates a polishing pad 110(*c*) in which the cleaning surface 152 of the cleaning element 150 is slightly higher than the plane defined by the planarizing surface 142 of the body 140. The polishing pad 110(*c*) is useful in applications that require more contact between the cleaning element 150 and the wafer (not shown) to enhance the removal of residual material from the surface of the wafer. FIG. 6 illustrates a polishing pad 110(*d*) in which the cleaning surface 152 of the cleaning element 150 is positioned below the plane defined by the planarizing surface 142. The polishing pad 110(*d*) is particularly useful for applications that require additional wetting of the wafer because the slurry 44 on top of the cleaning surface 152 will not be scraped off by the wafer (not shown) as it passes over the cleaning element 150. FIG. 7 shows a polishing pad 110(*e*) in which the cleaning surface 152 is positioned in the plane defined by the planarizing surface 142. The polishing pad 110(*e*) combines the qualities of the polishing pads 110(*c*) and 110(*d*) because the cleaning surface 152 engages the surface of the wafer (not shown), yet the wafer can pass over the cleaning element 150 without scraping an excessive amount of fluid off of the cleaning element 150.

Figure 8:
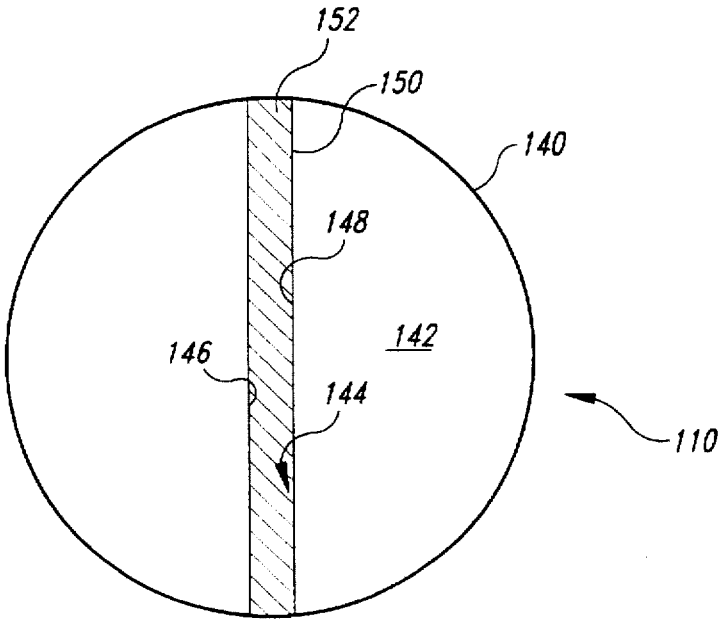
FIG. 8 is a schematic top elevational view of another polishing pad in accordance with the invention.
Figure 9:
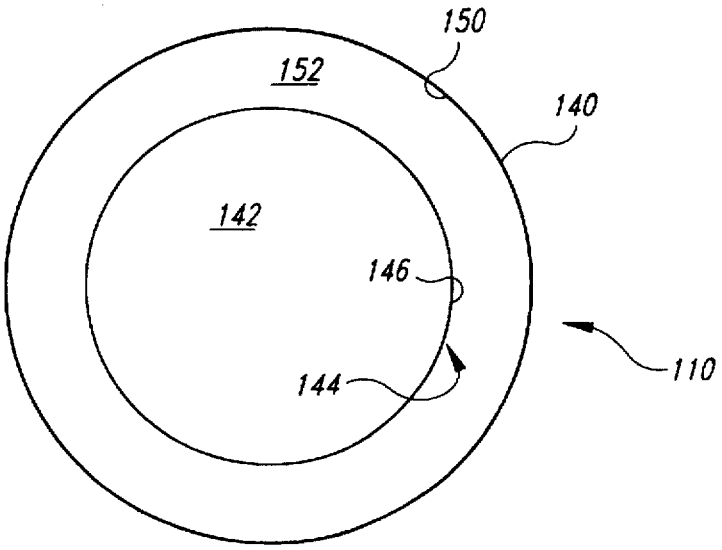
FIG. 9 is a schematic top elevational view of another polishing pad m accordance with the invention.
Figure 10:
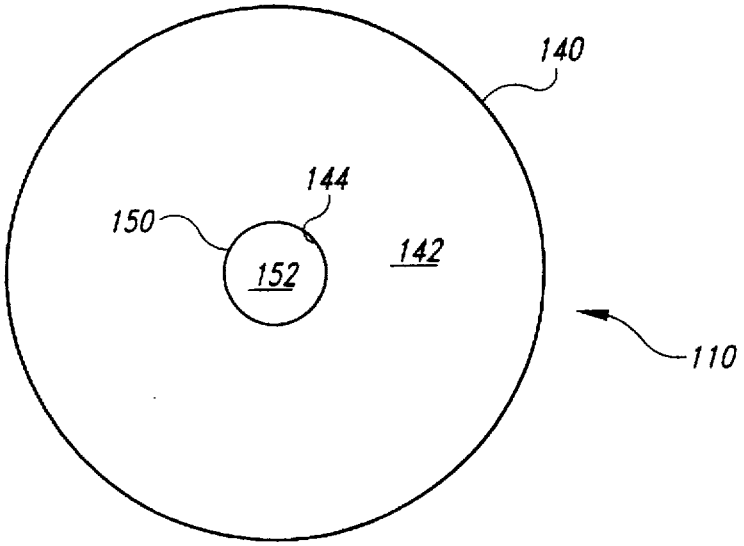
FIG. 10 is a schematic top elevational view of another polishing pad in accordance with the invention.
Figure 11:
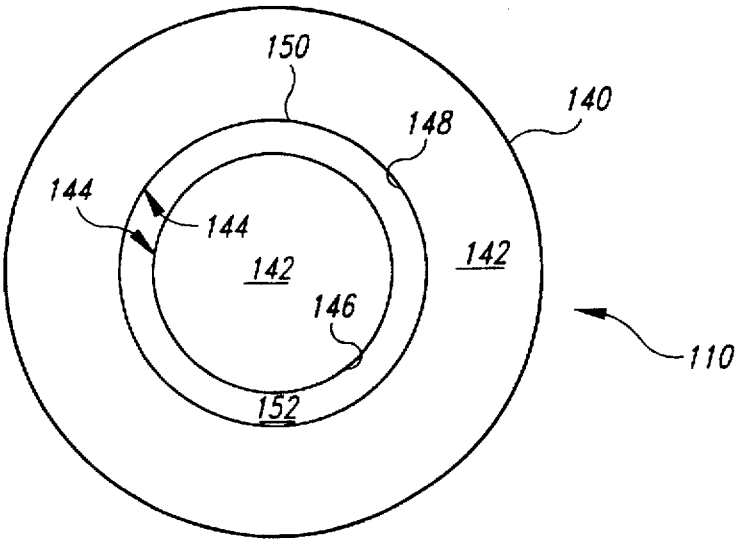
FIG. 11 is a schematic top elevational view of another polishing pad in accordance with the invention.

FIGS. 8–11 illustrate a polishing pad 110 with various configurations of cleaning elements 150, basins 144 and planarizing surfaces 142. Referring to FIG. 8, the basin 144 is a diametric trench that has first and second walls 146 and 148, respectively. The first and second walls 146 and 148 are substantially parallel to one another, and they extend across the body 140 to define a trench along the diameter of the body 140. The cleaning element 150 is positioned in the basin 144 to split the planarizing surface 142 of the pad 140 into two equal parts. Referring to FIG. 9, the basin 144 is a shoulder that extends around the perimeter of the planarizing surface 142 of the body 140. The cleaning element 150 extends from a circular wall 146 of the basin 144 to the edge of the body 140. The cleaning surface 152 accordingly surrounds the planarizing surface 142. Referring to FIG. 10, the basin 144 is a cylindrical depression positioned at the center of the body 140. The cleaning surface 152 of the cleaning element 150 accordingly extends from the center of the pad 110 to an intermediate radial position defined by the wall of the basin 144, and the planarizing surface 142 of the body 140 extends radially outwardly from the cleaning element 150. Referring to FIG. 11, the basin 144 is a concentric trench having first and second walls 146 and 148, respectively. The first wall 146 is positioned a first radial distance from the center of the pad 110, and the second radial wall 148 is positioned a second radial distance from the center of the pad 110. The cleaning element 150 is positioned in the concentric trench so that the cleaning surface 152 of the cleaning element forms a band between the first and second walls 146 and 148. The planarizing surface 142 of the body 140 extends from the center of the pad 110 to the first wall 146, and also from the second wall 148 to the perimeter of the body 140.

Figure 12:
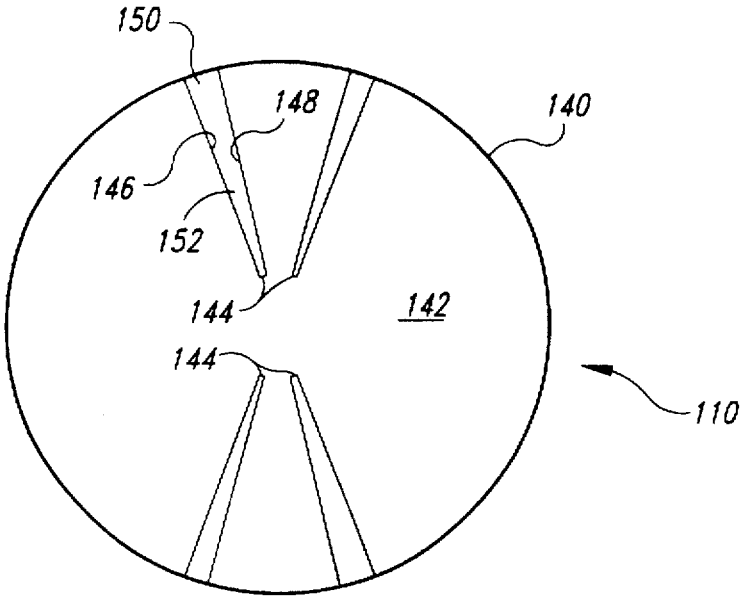
FIG. 12 is a schematic top elevational view of another polishing pad in accordance with the invention.

FIG. 12 illustrates the polishing pad 110 with another configuration of cleaning elements 150, basins 144 and planarizing surfaces 142 that provides a substantially constant contact rate between the pad 110 and the wafer (not shown). As discussed in U.S. Pat. Nos. 5,020,283, 5,232,875, and 5,297,364, all of which are herein incorporated by reference, certain configurations of voids in the planarizing surface result in a substantially constant surface contact rate between the planarizing surface and the wafer. Because the cleaning element 150 is non-abrasive, the basin 144 and cleaning element 150 may be configured in the patterns of the voids disclosed in the above-listed patents to provide a substantially constant contact rate between the planarizing surface 142 and the wafer. FIG. 12 illustrates one desirable configuration in which a number of wedge-shaped basins 144 are formed in the body 140 of the pad 110. Each basin 144 has first and second walls 146 and 148, respectively, that extend along different radii of the pad 110. The first and second walls 146 and 148 accordingly diverge from one another toward the perimeter of the body 140. A wedge-shaped cleaning element 150 is positioned in each of the wedge-shaped basins 144 to produce a ray-like pattern of cleaning elements 150 across the planarizing surface 142 of the body 140.

The polishing pad of the invention illustrated in FIGS. 2–12 produces a uniformly planar surface on the wafer without scratches caused by residual materials. Unlike conventional polishing pads, the polishing pad has a non-abrasive cleaning element that periodically engages the surface of the wafer while it is being planarized. The cleaning element accordingly removes residual material from the wafer and distributes additional slurry to the wafer. Moreover, when the basin and cleaning element are appropriately configured on the planarizing surface of the pad, the pad provides a substantially constant contact rate between the planarizing surface and the wafer. The polishing pad of the invention accordingly enhances the uniformity of the surface of the wafer.

It will be appreciated that, although specific embodiments of the invention have been described herein for purposes of illustration, various modifications may be made without departing from the spirit and scope of the invention. Accordingly, the invention is not limited except as by the appended claims.

We claim:

1. A polishing pad for planarization of a semiconductor wafer, comprising:

a polishing body having a planarizing surface facing the wafer, a basin formed in at least a portion of the body, and an opening at the planarizing surface defined by the basin, the planarizing surface being engageable with the wafer in the presence of a slurry; and a cleaning element positioned in the basin, the cleaning element having a non-abrasive cleaning surface positioned in the opening proximate to a plane defined by the planarizing surface to periodically engage the wafer during planarization on the pad in a manner that removes residual material from the wafer without abrading the wafer.

2. The polishing pad of claim 1 wherein the cleaning element comprises a soft, porous material.

3. The polishing pad of claim 2 wherein the soft porous material comprises a material selected from the group consisting of polyvinyl alcohol and polyvinyl acetate.

4. The polishing pad of claim 1 wherein the cleaning element comprises a brush having bristles that engage the wafer.

5. The polishing pad of claim 4 wherein the bristles are made from a material selected from the group consisting of polyvinyl alcohol and polyvinyl acetate.

6. The polishing pad of claim 1 wherein the cleaning surface is flush with the plane defined by the planarizing surface.

7. The polishing pad of claim 1 wherein the cleaning surface is positioned axially above the plane defined by the planarizing surface.

8. The polishing pad of claim 1 wherein the cleaning surface is positioned axially below the plane defined by the planarizing surface.

9. The polishing pad of claim I wherein the cleaning element is saturated with the slurry to enhance the distribution of slurry across the wafer.

10. The polishing pad of claim 1 wherein the cleaning element is hydrated with deionized water to enhance removal of residual material from the wafer.

11. The polishing pad of claim 1 wherein the planarizing surface defines an abrasive surface area and the cleaning surface defines a non-abrasive surface area, the ratio of the non-abrasive surface area to the abrasive surface area increasing radially outwardly with respect to the center of the pad to provide a substantially constant contact rate between the planarizing surface and the wafer.

12. The polishing pad of claim 11 wherein the basin comprises a wedge-shaped trench having a first side on one radius of the pad and a second side on another radius of the pad, and wherein the cleaning element is wedge-shaped and mates with the wedge-shaped trench.

13. The polishing pad of claim 12 wherein a plurality of wedge-shaped cleaning elements are positioned in a corresponding plurality of wedge-shaped trenches.

14. The polishing pad of claim 13 wherein the cleaning elements are spaced apart from one another by an equal distance.

15. The polishing pad of claim 1 wherein the basin comprises a diametric trench and the cleaning element comprises a diametric member that mates with the diametric trench.

16. The polishing pad of claim 1 wherein the basin comprises a concentric trench having a first side positioned a first radial distance from the center of the pad and a second side positioned a second radial distance from the center of the pad, and wherein the cleaning element comprises a band that mates with the concentric trench.

17. The polishing pad of claim 12 wherein the first and second sides diverge from one another radially outwardly towards the perimeter of the pad at an angle between 10 and 60 degrees.

18. A planarizing machine for chemical-mechanical planarization of a semiconductor wafer, comprising:

a platen;

a polishing pad positioned on the platen, the polishing pad including a polishing body and a cleaning element positioned in the polishing body, the polishing body having a planarizing surface facing the wafer, a basin formed in at least a portion of the body, and an opening at the planarizing surface defined by the basin, and the cleaning element having a cleaning surface positioned in the opening proximate to a plane defined by the planarizing surface;

a wafer carrier positionable opposite the polishing pad; and an actuator connected to one of the wafer carrier or the platen, the actuator moving the one of the wafer carder or the platen with respect to the other to engage the wafer with the polishing pad and impart motion between the wafer and the polishing pad, whereby the planarizing surface reduces the thickness of the wafer and the cleaning surface removes residual material from the wafer.

19. The polishing pad of claim 18 wherein the cleaning element comprises made from a soft, porous material.

20. The polishing pad of claim 19 wherein the soft porous material comprises a material selected from the group consisting of polyvinyl alcohol and polyvinyl acetate.

21. The polishing pad of claim 18 wherein the cleaning element comprises a brush having bristles that engage the wafer.

22. The polishing pad of claim 20 wherein the bristles are made from a material selected from the group consisting of polyvinyl alcohol and polyvinyl acetate.

23. The polishing pad of claim 18 wherein the cleaning surface is flush with the plane defined by the planarizing surface.

24. The polishing pad of claim 18 wherein the planarizing surface defines an abrasive surface area and the cleaning surface defines a non-abrasive surface area, the ratio of the non-abrasive surface area to the abrasive surface area increasing radially outwardly with respect to the center of the pad to provide a substantially constant contact rate between the planarizing surface and the wafer.

25. In chemical-mechanical planarization of semiconductor wafers, a method for planarizing and cleaning a wafer, comprising the steps of:

pressing the wafer against a polishing pad in the presence of a slurry, the polishing pad including a polishing body and a cleaning element positioned in the polishing body, the polishing body having a planarizing surface facing the wafer, a basin formed in at least a portion of the polishing body, and an opening at the planarizing surface defined by the basin, and the cleaning element having a cleaning surface positioned in the opening proximate to a plane defined by the planarizing surface; and moving at least one of the wafer or the pad with respect to the other to alternate passing the wafer over the planarizing surface and the cleaning surface while the wafer continuously presses against the pad.

26. The method of claim 25, further comprising the step of saturating the cleaning element with slurry.

27. The method of claim 25, further comprising the step of hydrating the cleaning element with deionized water.

* * * * *

UNITED STATES PATENT AND TRADEMARK OFFICE

CERTIFICATE OF CORRECTION

PATENT NO. : 5,738,567
DATED : April 14, 1998
INVENTOR(S) : Adam Manzonie and Salman Akram It is certified that error appears in the above-identified patent and that said Letters Patent is hereby corrected as shown below:

Column 1, Line 39 reads, "carder" should read - - carrier - -

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*